United States Patent [19]

Stern et al.

[11] Patent Number: 4,991,693

[45] Date of Patent: Feb. 12, 1991

[54] METHOD OF IMPROVING THE LANDING OF A HYDRAULIC ELEVATOR CAR

[75] Inventors: Lawrence Stern, Morristown; Jeffrey W. Blain, Scenic Lakes Township, Sussex County, both of N.J.

[73] Assignee: Inventio AG, Hergiswil, Switzerland

[21] Appl. No.: 311,507

[22] Filed: Feb. 16, 1989

[51] Int. Cl.[5] ..... B66B 1/26

[52] U.S. Cl. ..... 187/111; 187/134; 187/29.2

[58] Field of Search ..... 187/111, 110, 134, 116, 187/117, 29.2

[56] References Cited

U.S. PATENT DOCUMENTS

| | | | |
|---|---|---|---|
| 3,743,056 | 7/1973 | Zitelli et al. | 187/29 R |
| 4,019,606 | 4/1977 | Caputo et al. | 187/29 R |
| 4,322,703 | 3/1982 | Jackson et al. | 335/205 |
| 4,494,628 | 1/1985 | Uherek et al. | 187/29 R |
| 4,534,452 | 8/1985 | Ogasawara et al. | 187/29 A |
| 4,715,478 | 12/1987 | Nakamura et al. | 187/111 |

FOREIGN PATENT DOCUMENTS

| | | | |
|---|---|---|---|
| 3638247 | 5/1987 | Fed. Rep. of Germany | 187/111 |
| 0145252 | 12/1978 | Japan | 187/111 |
| 2087105 | 5/1982 | United Kingdom | 187/111 |

*Primary Examiner*—M. H. Paschall

*Attorney, Agent, or Firm*—D. R. Lackey

[57] ABSTRACT

A method of improving the landing of a hydraulic elevator car which responds to slowdown and leveling indicia associated with each floor of a building served by the car. The method, which utilizes signals which are already generated relative to the car traveling past slowdown and leveling indicia, provides an optimum deceleration time TOPT for the car to initiate deceleration and arrive at a leveling zone of a target floor, defined by leveling indicia. The method further delays the initiation of deceleration of the car, after the car reaches slowdown indicia for the target floor, by a predetermined time delay Td. The method determines the actual time TACT for the car to travel between slowdown and leveling indicia for the target floor, and then changes Td, if necessary, in a direction which tends to optimize Td, when TACT - Td is not equal to TOPT.

9 Claims, 5 Drawing Sheets

| ROM 80 |
| --- |
| K1 |
| K2 |
| Td |
| TOPT |

| RAM 82 |
| --- |
| Td (FLOOR #1-DN) |
| Td(FLOOR #2-UP) |
| Td(FLOOR #2-DN) |
| Td(FLOOR #N-UP) |
| SLOWDOWN TIMER |
| DELAY TIMER |
| FLAG KH1 |
| FLAG KH2 |
| TACT |
| DIFF |

METHOD OF IMPROVING THE LANDING OF A HYDRAULIC ELEVATOR CAR

TECHNICAL FIELD

The invention relates in general to elevator cars, and more specifically to improving the landing of hydraulic elevator cars.

BACKGROUND ART

The acceleration rate, full speed velocity, and deceleration rate of a hydraulically driven elevator car, regardless of whether the car is mounted on the end of a plunger of a hydraulic cylinder, or rope driven in response to plunger movement, are all subject to deviation from desired or reference values. The deviation is responsive to the load in the elevator cab, the car travel direction, the location of the car in a building, and the temperature of the hydraulic oil. Deceleration of a hydraulic elevator car is initiated by de-energizing a high speed valve, and the car then decelerates until it reaches a predetermined landing speed. Then the car travels at landing speed until it enters a leveling zone for the target floor, defined by indicia in the hatchway. The car is stopped by de-energizing a stop valve. The position of the car in the building, as affected by buoyancy of the plunger, the oil viscosity, which changes with temperature, the car loading, and the car travel direction, all have a bearing upon when the car will reach landing speed. If the car reaches landing speed too soon, it will creep to the landing or leveling zone, deleteriously affecting elevator service, as well as increasing the anxiety of passengers who sense the amount of time between a change in deceleration rate when landing speed is reached and the opening of the car doors. Electrical power is also wasted when a hydraulically driven elevator car is creeping into a floor in the up travel direction, as the pump motor is operated in the up travel direction.

Many different arrangements are utilized in the prior art for overcoming these disadvantages, but all require one or more hardware items which add cost to the installation, such as special valves which are compensated for load and/or oil temperature and/or travel direction, special detectors, which detect car speed, car load, oil temperature, and the like.

It would be desirable, and it is the object of the present invention to improve the landing of a hydraulically driven elevator car, without adding any additional hardware, using hardware and signals which are already present in any computer operated hydraulically driven elevator car.

SUMMARY OF THE INVENTION

Briefly, the present invention is a method of improving the landing of a hydraulic elevator car at a target floor, which method utilizes hatch indicia already present in a hydraulic elevator system, and signals initiated in response thereto, along with software timers set up in the memory of a computer which runs programs for controlling the operation of the elevator car. The method detects slowdown indicia for a target floor and then initiates slowdown of the car a predetermined time delay Td thereafter. The time delay Td is stored in computer memory, and changed when necessary, in a direction which tends to optimize it, by comparing the actual time TACT to decelerate the car and reach the leveling zone of the target floor with an optimum value TOPT stored in memory. In a preferred embodiment of the invention, a value for Td is stored for each floor of the associated building, and even for each travel direction from which the floor may be approached by the elevator car. The stored values may even be associated with the time of day, if desired, if the building has a traffic pattern which is similar each day, e.g., loaded cars going up in the morning, down in the evening, and partially loaded cars going in both directions during off peak hours.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
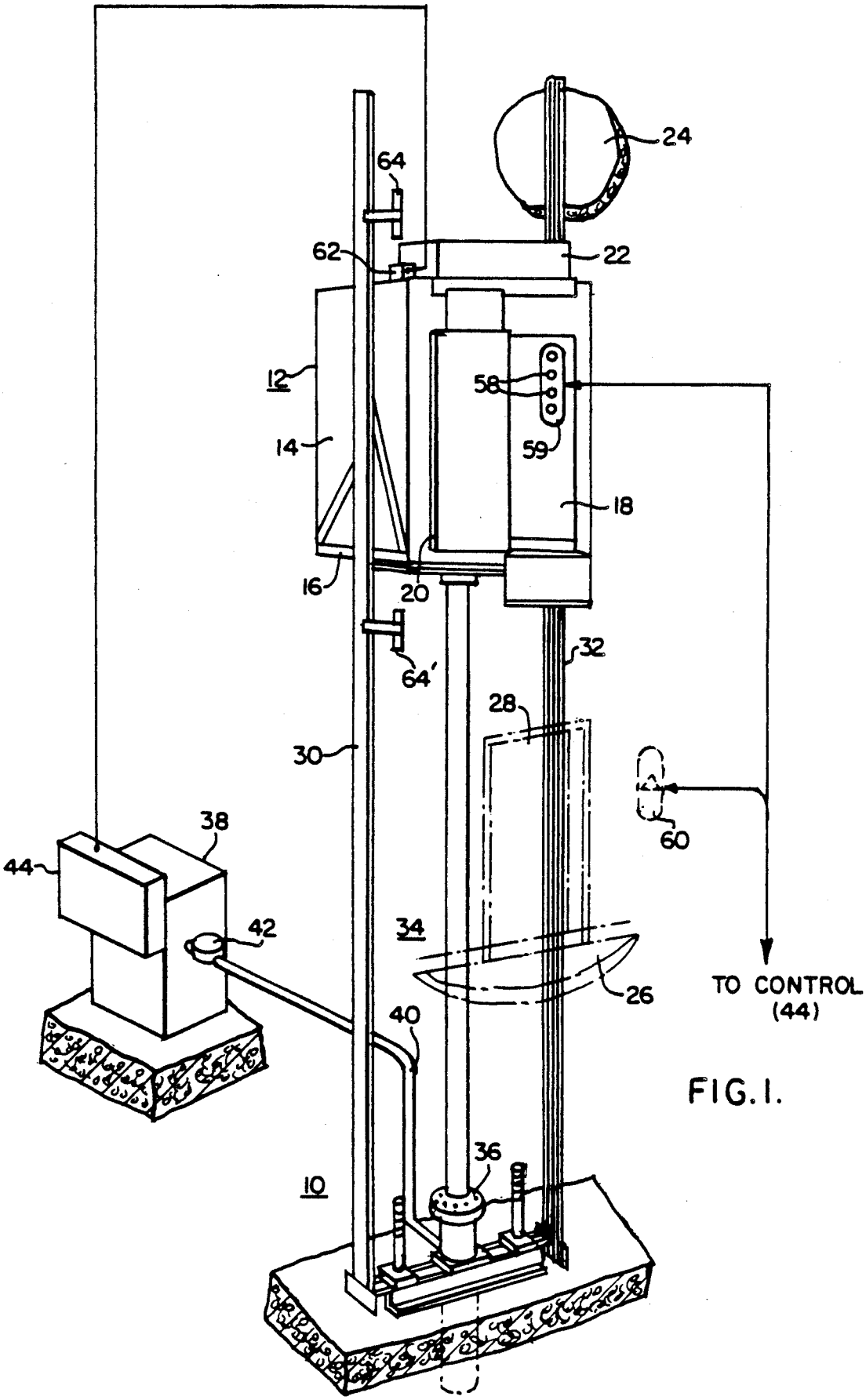
FIG. 1 is a perspective view of a hydraulic elevator car whose landings may be improved by the teachings of the invention.

Referring now to the drawings, and to FIG. 1 in particular, there is shown a hydraulic elevator system 10 which may utilize the teachings of the invention. Elevator system 10 includes an elevator car 12 comprising a passenger cab 14 mounted on a sling and platform assembly 16. Cab 14 defines a passenger compartment, which has an opening 18, a door 20 for the opening, and a door operator 22 which slidably operates door 20 between the open position illustrated and a closed position.

Elevator car 12 is mounted for guided vertical movement in the hatchway 24 of a structure or building having floors to be served by car 12, such as floor 26 shown in phantom. Floor 26 includes a hatch door 28 which is operated in unison with car door 20 when car 12 is located at floor 26.

Elevator car 12 is guided and stabilized in its vertical travel path via guide rails 30 and 32 suitably attached to the walls of hatch 24 via rail brackets (not shown) and guide roller assemblies (not shown) on car 12 which co-act with the guide rails.

Motive means for elevator car 12 includes a hydraulic system 34 comprising a jack assembly 36, a hydraulic power unit 38, suitable piping 40 which provides fluid flow communication between power unit 38 and jack assembly 36, valve means 42 for controlling the flow of hydraulic fluid, such as oil, and electrical control 44. Electrical control 44 includes car control and power unit control, such as a line contactor, door relays, direction relays, and a floor selector function.

Elevator car 12 is controlled in response to calls for elevator service, such as may be initiated via car call push buttons 58 mounted in a car station 59 in the passenger compartment of cab 14, and via hall call push buttons, such as push button 60, located in the hallways of the various floors, and in response to car position translating means. The car position translating means includes control 62 carried by cab 14, and a plurality of landing and leveling zone devices 64, one for each floor, which are fixed in the hatch 24.

Figure 2:
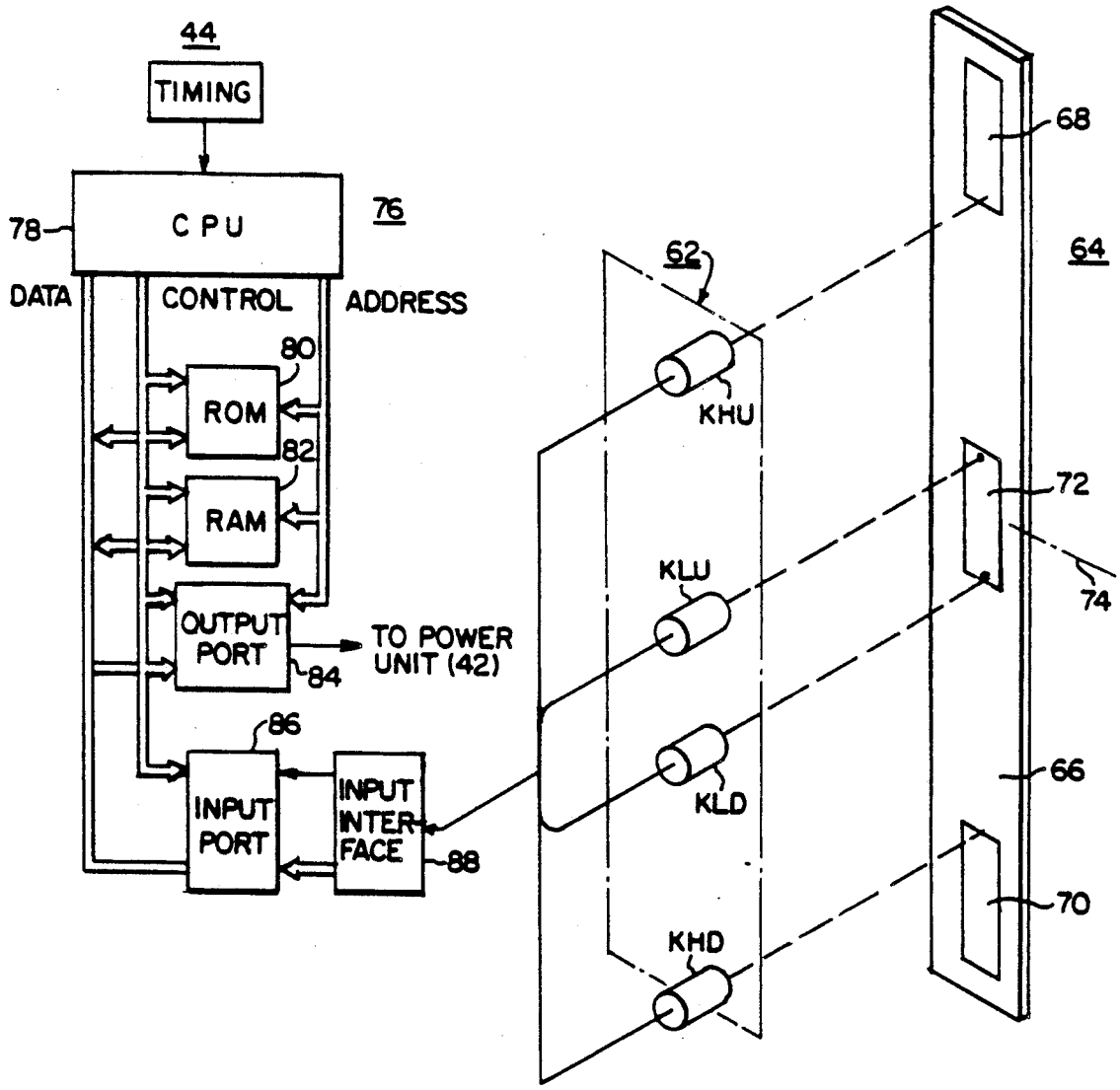
FIG. 2 is a partially diagrammatic view and a partially block diagram which illustrates exemplary hatch indicia for identifying slowdown and landing zones for a target floor, photocell apparatus for detecting the zones, and computer operated control responsive to signals generated by the photocell apparatus.

The landing and leveling zone devices 64 may include actuator vanes and the control 62 may include switches actuated by the vanes, as disclosed in U.S. Pat. No. 4,322,703; or, the control 62 may include a photoelectric detector, such as shown in U.S. Pat. Nos. 3,743,056 and 4,019,606, and the zone devices 62 may be reflectors of electromagnetic energy, such as shown in U.S. Pat. No. 4,494,628, all of which patents are assigned to the same assignee as the present application. For purposes of example, a photo-electric arrangement is set forth in FIG. 2, which illustrates exemplary cab mounted control 62, a hatch mounted reflector 64, and control 44, which may be mounted on the hydraulic power unit 38.

More specifically, control 62 includes four opto-electronic reader pairs KHU, KHD, KLU, and KLD, each comprising a transmitter, such as a light emitting diode, and a receiver or detector, such as a phototransistor, arranged such that when a transmitted beam of electromagnetic energy strikes a reflective target, the receiver will receive the energy and provide a signal which will be identified with the same letters as the associated reader pair. It would also be suitable to use opaque targets, with the transmitter and receiver being spaced apart, with the receiver normally receiving a transmission except when the opaque target intervenes.

The reflector 64 includes a support plate 66 having a single lane of vertically spaced reflective targets 68, 70 and 72. Target 72 is bisected by the floor level of the associated floor, indicated by broken line 74, with target 72 establishing the landing and leveling zone. Target 72, for example, may be 6 inches long, providing a landing and leveling zone of ±3 inches relative to floor level. Targets 68 and 70 establish slowdown zones relative to an associated floor. According to the teachings of the invention, the length of the slowdown zones are selected such that a car under conditions requiring the longest slowdown would not require the slowdown distance provided by targets 68 and 70. For example, targets 68 and 70 may be dimensioned to start 10 inches from floor level 74, but other dimensions may be used, depending upon the specific elevator system they are associated with.

Optical readers KHU and KHD are spaced apart such that when car 12 is traveling upwardly, reader pair KHU will detect the start of target 70 when the car enters the defined slowdown zone, with the resulting signal being referred to as KHU. In like manner, when car 12 is traveling downwardly, reader pair KHD will detect the start of target 68 when car 12 enters the slowdown zone, and the resulting signal is referred to as KHD.

Optical readers KLU and KLD are spaced apart such that when car 12 is traveling upwardly, reader pair KLU will detect the lower edge of target 72 when car 12 enters the landing and leveling zone, providing a signal KLU. When car 12 is traveling downwardly, reader pair KLD will detect the upper edge of target 72 when car 12 enters the landing and leveling zone, providing a signal KLD. When both reader pairs KLU and KLD detect target 72 simultaneously, providing true signals KLU and KLD, the stop solenoid is de-energized, stopping the car.

Figures 3, 4, 5:
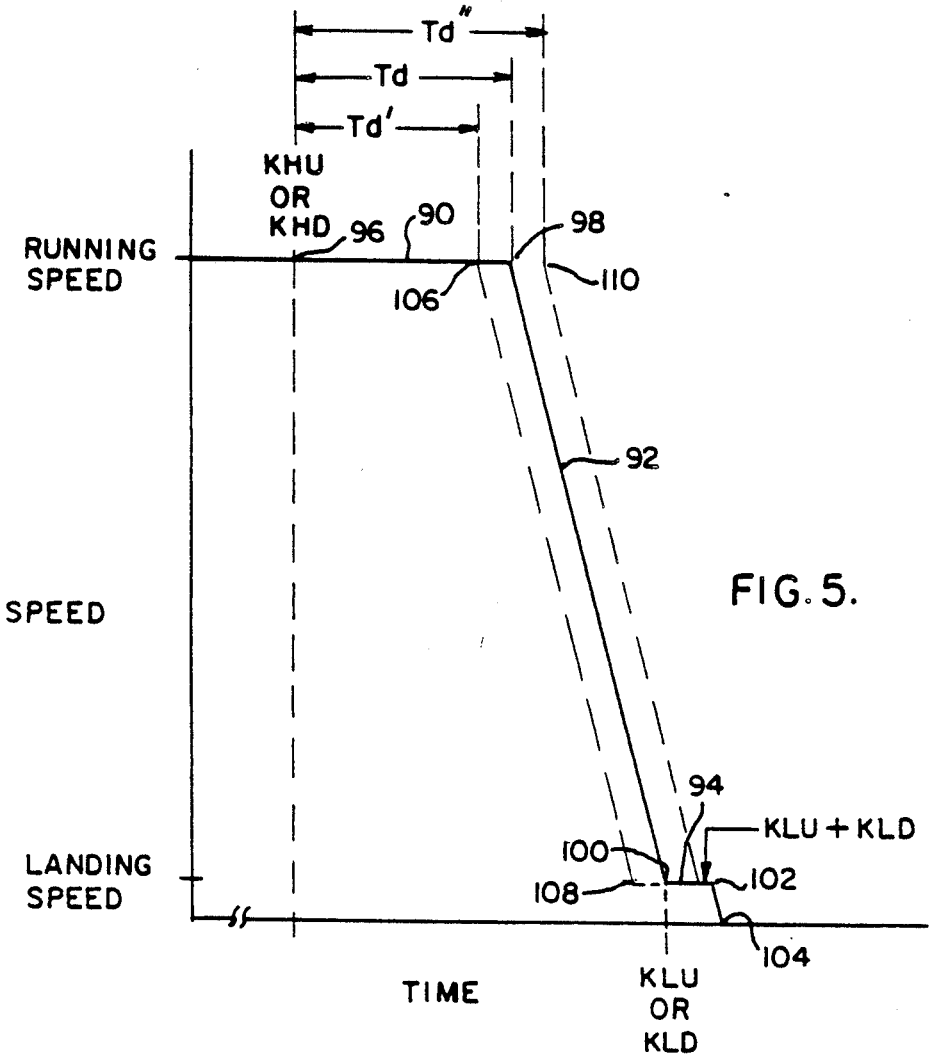
FIG. 3 is a ROM map setting forth certain constants used in programs set forth in FIGS. 6 and 7 which implement the teachings of the invention.
FIG. 4 is a map setting forth certain variables generated by the programs set forth in FIGS. 6 and 7.
FIG. 5 is a graph which plots car speed versus time as the car is decelerated from running speed to landing speed, preparatory to stopping in the landing zone of a target floor.

Signals KHU, KHD, KLU and KLD are all sent to car control 44 which includes a microcomputer 76 having a central processing unit (CPU) 78, a read only memory (ROM) 80, a random access memory (RAM), an output port 84, an input port 86, and an input interface 88. The signals from control 62 are applied to microcomputer 76 via input interface 88, and signals for power unit 42 are output via the output port 84. FIGS. 3 and 4 illustrate ROM and RAM maps for ROM 80 and RAM 82, respectively, which will be hereinafter be referred to.

The present invention provides a time delay Td which starts when a true signal KHU or KHD is received, indicating the arrival of car 12 at the slowdown zone of a target floor. FIG. 5 is a graph which plots car speed versus time, with the solid curve indicating an optimum running speed, deceleration and landing speed at curve portions 90, 92 and 94, respectively. The time delay Td starts at point 96 and it expires at point 98, at which time the high speed valve is de-energized and deceleration 92 begins. When a predetermined landing speed 94 is reached at point 100, deceleration ceases and the car runs towards the floor at landing speed until both KLU and KLD are true simultaneously at point 102, at which point the stop solenoid is de-energized and the car stops at point 104.

A default time delay Td is provided in ROM 80, as indicated in FIG. 3. A single default time delay may be provided, which will then be optimized for each floor, and for each service direction, if desired, or a default time delay may be provided for each floor, and for each service direction from each floor, as desired.

As shown in FIG. 5, if the time delay Td presently being used expires at point 106, and the car loading, oil temperature, floor location, and travel direction are such that landing speed is reached at point 108, the car will travel too long at landing speed. In this situation, the invention will automatically increase the time delay Td, to cause Td to approach the optimum shown in solid. If the time delay Td presently being used expires at point 110, the car will enter the landing and leveling zone above landing speed, and may cause a rough landing. In this situation, the time delay will automatically be reduced, to cause it to approach the optimum for the conditions as they presently exist for the elevator car. This automatic correction is done without requiring any additional detection devices, utilizing only what is presently available in a computer operated hydraulic elevator system.

Figure 6:
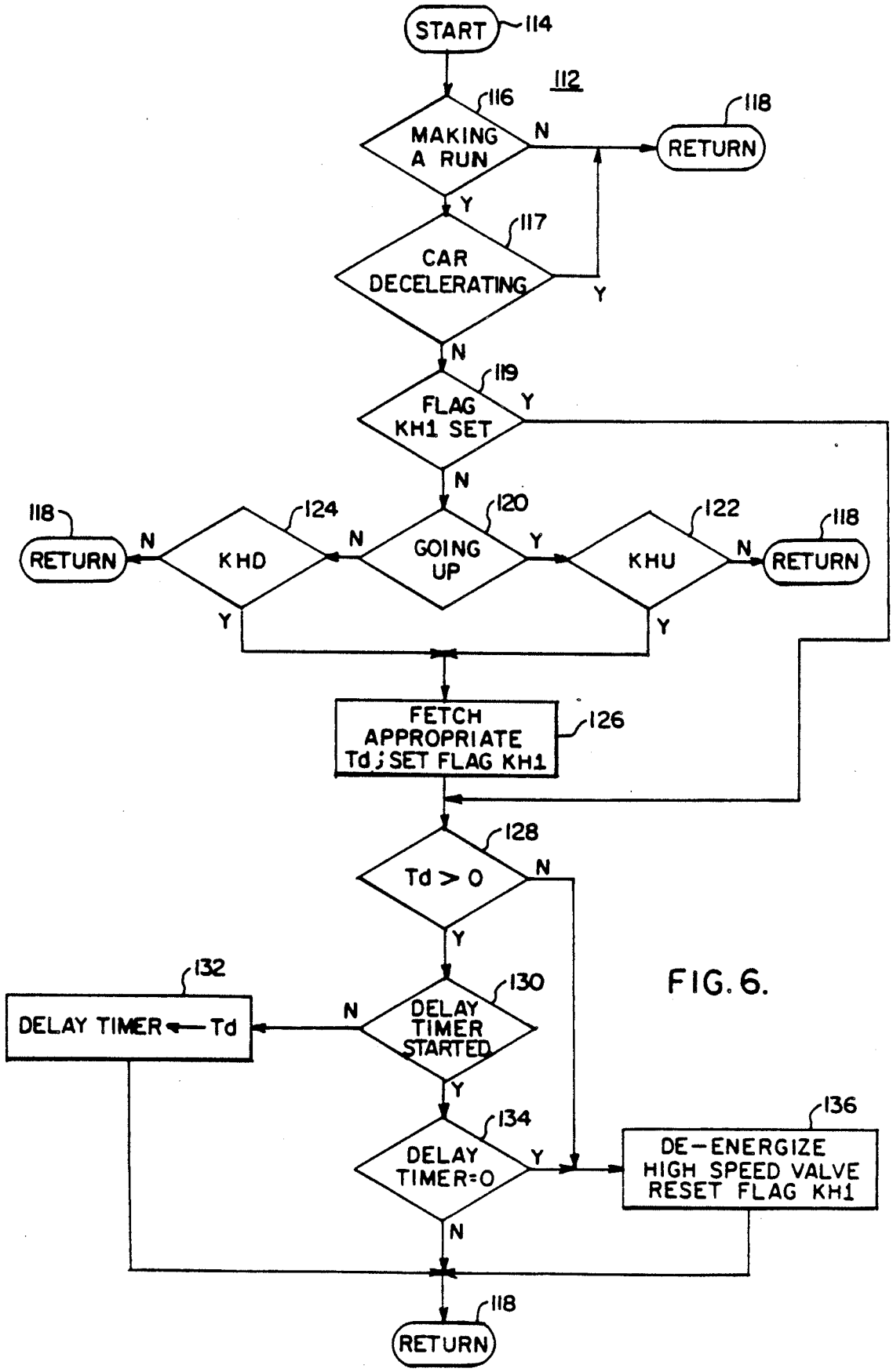
FIG. 6 is a detailed flow chart of a program which sets a delay timing function to the value of Td when slowdown indicia for a target floor is detected, and which de-energizes a high speed valve to initiate deceleration when the time delay Td expires.
Figure 7:
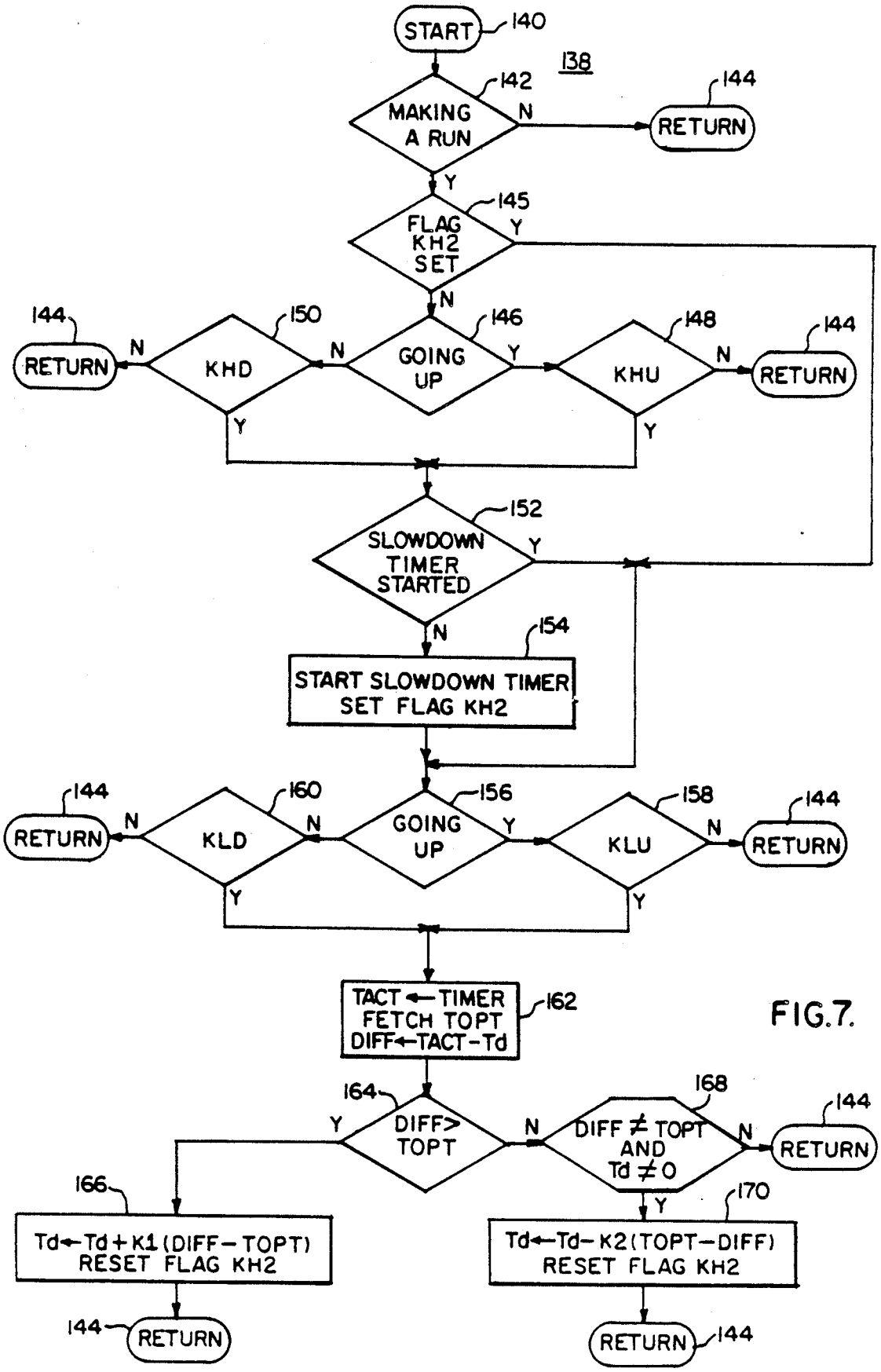
FIG. 7 is a detailed flow chart of a program which compares expected car landing performance with actual performance, and which changes the time delay Td, when necessary, in a direction which tends to optimize performance.

More specifically, FIGS. 6 and 7 are detailed flow charts of programs 112 and 138, respectively, formulated according to the teachings of the invention, with FIG. 6 setting the time delay to the latest value of Td when slowdown indicia is detected for a target floor, and FIG. 7 modifying Td, when necessary to correct it in a direction which tends to optimize it.

Program 112 of FIG. 6 is entered at 114 and step 116 determines if car 12 is making a run. If it is not making a run, the program exits at 118. When step 116 finds that car 12 is making a run, step 117 checks to see if the high speed valve has been de-energized, indicating the car is already decelerating towards a target floor. If the car is already decelerating, step 117 exits the program at 118. If the car is making a run, and is not decelerating, step 119 checks RAM 82 to see if a flag KHl is set. If flag KHI is not set it indicates that the run has not progressed to the slowdown phase, and step 120 checks the car travel direction. If car 12 is going up, step 122 determines if a true signal KHU has been received. If not, the program returns at 118. In like manner, when car 12 is going down, step 120 proceeds to step 124 which checks to see if a true signal KHD has been received. When either step 122 or step 124 detects a true signal KHU or KHD, respectively, the program advances to step 126 which obtains the appropriate time delay Td from RAM 82. RAM 82 is initially loaded with default values from ROM during initialization, and then the values are modified, as necessary, as the car 12 stops at the floors of the building throughout a day. Step 126 also sets flag KHI, to indicate that the slowdown phase of a run has been initiated. Step 126 proceeds to step 128, as does step 119 when it finds flag KHI set, and step 128 determines if the time delay Td is zero. If Td is zero, then step 136 immediately de-energizes the high speed valve to initiate deceleration of car 12. Step 136 also resets flag KHl. Normally, the slowdown zone length will be such that the time delay Td will not be zero, but step 128 is included as a precaution.

When step 128 finds Td is greater than zero, step 130 checks to see if the software delay timer (RAM 82) has been initialized with a count value. If it has not been initialized, step 132 loads the delay timer with a count value equal to the time delay Td, and the program returns at 118. When step 130 finds that the delay timer is active, step 134 determines if a timer program has decremented the delay timer to zero. When the delay timer is not zero, the program returns at 118. When the delay timer has been decremented to zero, step 136 de-energizes the high speed solenoid valve and resets flag KHI, to initiate deceleration of car 12.

Program 138 of FIG. 7 is entered at 140 and step 142 checks to see if car 12 is making a run. If it is not, the program returns at 144. If car 12 is making a run, step 144 checks to see if a flag KH2 is set. If flag KH2 is not set, it indicates that the slowdown phase of the run has not been initiated, and step 146 checks the car travel direction. If car 12 is going up, step 148 checks to see if a true signal KHU has been provided. If not, the program returns at 144. In like manner, when car 12 is going down, step 150 checks for a true signal KHD.

When either step 144 or step 150 detect a true signal KHU or KHD, respectively, step 152 checks RAM 82 to see if a slowdown timer has been started. If the slowdown timer has not been started, step 154 starts the timer, which is incremented upwardly from zero, and step 154 also sets flag KH2. Step 154 then advances to step 156 to check the travel direction of car 12, and the "yes" branches from steps 145 and 152 also advance to step 156.

If step 156 finds car 12 traveling upwardly, step 158 checks to see if detector KLU has provided a true signal KLU. If not the program exits at 144. In like manner, when step 156 finds car 12 is traveling downwardly, step 160 checks for a true signal KLD from detector KLD.

Figure 8:
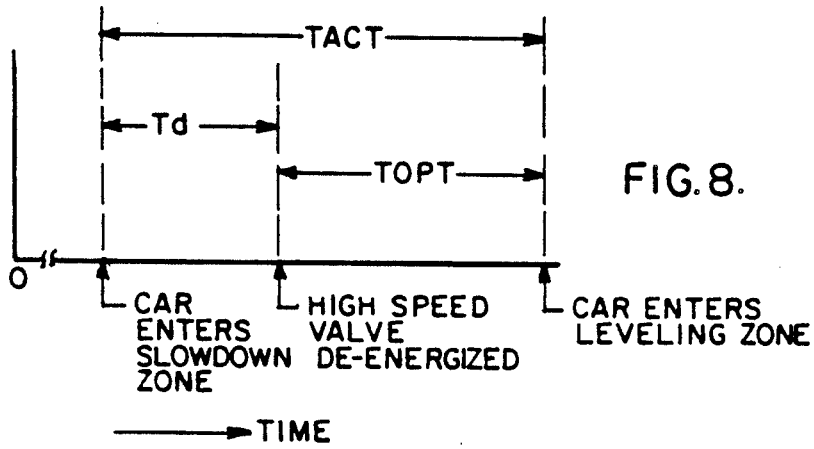
FIG. 8 is a chart which illustrates the relationship between certain actual and optimum time values referenced TACT and TOPT, respectively, and the time delay Td.

Once steps 158 or 160 detect a true signal KLU or KLD, respectively, they advance to step 162 which reads the elapsed time on the slowdown timer and stores it at location TACT in RAM 82. Thus, as shown in FIG. 8, TACT is the actual time it took for car 12 to travel from the start of the slowdown zone, signified by a true signal KHU or KHD, to the start of the landing and leveling zone, signified by a true signal KLU or KLD.

Step 162 also reads the optimum time TOPT for car 12 to decelerate from running speed to landing speed, which is stored in ROM 80. This may be a single value for all floors and travel directions; it may be a separate value for each floor; or, it may be a separate value for the up and down service directions for each floor, as desired. Step 162 then subtracts the time delay Td used during the run from the time TACT and stores it at a location DIFF in RAM 82.

Step 164 determines if the difference DIFF between TACT and Td is greater than TOPT. If it is, it indicates that the delay time should be made longer in order to modify Td towards the optimum, and step 166 multiplies the difference between DIFF and TOPT by a predetermined constant Kl stored in ROM. The result is added to Td and the new Td is stored at the appropriate location in RAM 82. Instead of correcting DIFF to equal TOPT in one step, it is better to incrementally change the time delay Td each time the car stops at the associated floor, and the constant Kl is selected according to the increment by which it is desired to change Td. Step 166 also resets flag KH2.

If step 164 finds that DIFF does not exceed TOPT, step 168 determines if DIFF is equal to TOPT. If they are equal, nothing need be done to the time delay Td, and the program exits at 144. If DIFF is not equal to TOPT, step 168 determines if Td is equal to zero. If Td is zero, and since the modification being called for is to make Td smaller, nothing further can be done in the way of modifying Td and the program exits at 144. If step 168 finds that DIFF is not equal to TOPT and the time delay Td is not equal to zero, then the time delay may be made smaller, and step 170 performs this function.

Step 170 subtracts DIFF from TOPT and multiplies the difference by a predetermined constant K2 stored in ROM 80, The result is subtracted from Td and the new Td is stored at the appropriate location in RAM 82. Step 170 also resets flag KH2.

In summary, there has been disclosed a method of optimizing the landing of a hydraulically powered elevator car, accommodating change in temperature of the hydraulic fluid, position of the target floor in a building, travel direction, and even car loading if time delays are stored for different time intervals of a day. The method provides an optimum deceleration time TOPT for the hydraulic elevator car in question to decelerate from running speed and enter the landing and releveling zone of a target floor. Slowdown indicia are set relative to each floor such that a time delay Td is normally required between the detection of slowdown indicia for a target floor and the initiation of deceleration. A stored time delay Td is used, the actual performance of the car is timed, and if the actual performance deviates from the optimum, the stored time delay is modified in a direction which tends to optimize Td.

We claim:

1. A method of improving the landing of a hydraulic elevator car, during each run of the elevator car, at a floor of a building having slowdown and leveling indicia associated with each floor, comprising the steps of:

providing an optimum deceleration time (TOPT) for the elevator car, initiating a run of the elevator car, delaying the initiation of deceleration of the elevator car, after the elevator car reaches a slowdown indicia associated with the target floor, by a predetermined time delay Td, timing the actual time of the elevator car to travel between slowdown and leveling indicia associated with a target floor, to provide a time TACT, comparing TACT - Td with TOPT, changing Td in a direction which brings TACT- Td closer to TOPT when TACT - Td is not equal to TOPT, and using the changed Td during a subsequent run of the elevator car.

2. The method of claim 1 wherein the step of changing Td increases Td when TACT - Td is greater than TOPT.

3. The method of claim 2 wherein the step of increasing Td increases Td by an amount responsive to the difference between TACT - Td and TOPT.

4. The method of claim 1 wherein the step of changing Td decreases Td when TOPT is greater than TACT - Td.

5. The method of claim 4 wherein the step of decreasing Td decreases Td by an amount responsive to the difference between TOPT and TACT - Td.

6. The method of claim 1 wherein the step of providing an optimum deceleration time TOPT for the elevator car provides a value specific to each target floor.

7. The method of claim 1 wherein the step of providing an optimum deceleration time TOPT for the elevator car provides a value specific to each target floor and the stopping direction.

8. The method of claim 1 including the step of providing an initial default value for Td.

9. The method of claim 1 wherein the step of providing an optimum deceleration time TOPT indicates the desired time between the initiation of slowdown and arrival at leveling indicia for a target floor.

* * * * *